United States Patent [19]

Fried et al.

[11] Patent Number: 4,474,009

[45] Date of Patent: Oct. 2, 1984

[54] CONTROL APPARATUS FOR AN AIR THROTTLE VALVE IN THE INTAKE MANIFOLD OF AN INTERNAL COMBUSTION ENGINE

[75] Inventors: Reinhard Fried, Nussbaumen, Switzerland; Heimo Hübner, Greifenberg, Fed. Rep. of Germany

[73] Assignees: BBC AG Brown Boveri & Cie, Baden, Switzerland; Knorr-Bremse GmbH, Munich, Fed. Rep. of Germany

[21] Appl. No.: 204,859

[22] Filed: Nov. 7, 1980

[30] Foreign Application Priority Data

Nov. 9, 1979 [DE] Fed. Rep. of Germany ..... 2945230

[51] Int. Cl.[3] ..... F02B 37/00

[52] U.S. Cl. ..... 60/611; 123/179 A; 123/559

[58] Field of Search ..... 123/559, 179 A, 65 E; 60/611

[56] References Cited

U.S. PATENT DOCUMENTS

| | | | |
|---|---|---|---|
| 2,853,987 | 9/1958 | Berchtold et al. | 123/65 E |
| 3,180,330 | 4/1965 | Barnes | 123/559 X |
| 4,075,990 | 2/1978 | Ribeton | 123/559 |
| 4,154,060 | 5/1979 | Deprez et al. | 60/611 |
| 4,206,607 | 6/1980 | Heberle et al. | 60/611 |

*Primary Examiner*—William A. Cuchlinski, Jr.
*Attorney, Agent, or Firm*—Edmund M. Jaskiewicz

[57] ABSTRACT

The invention discloses an apparatus for adjusting or actuating an air throttle valve positioned in the intake manifold of an internal combustion engine which is supplied by air under pressure. The air throttle valve is held in a closed position by a spring when the engine is in the cold starting phase. Air is supplied to the engine through a by-pass valve when the air throttle valve is closed. The air throttle valve is opened against the force of the spring in response to a predetermined pressure or vacuum in the intake manifold at the end of the cold starting phase. The air throttle valve is held in an open position by an electro-magnetic structure which is effective when an ignition circuit of the vehicle is energized or by a detent structure which is effective when the engine or exhaust temperatures are at predetermined levels.

10 Claims, 10 Drawing Figures

Figure 1:
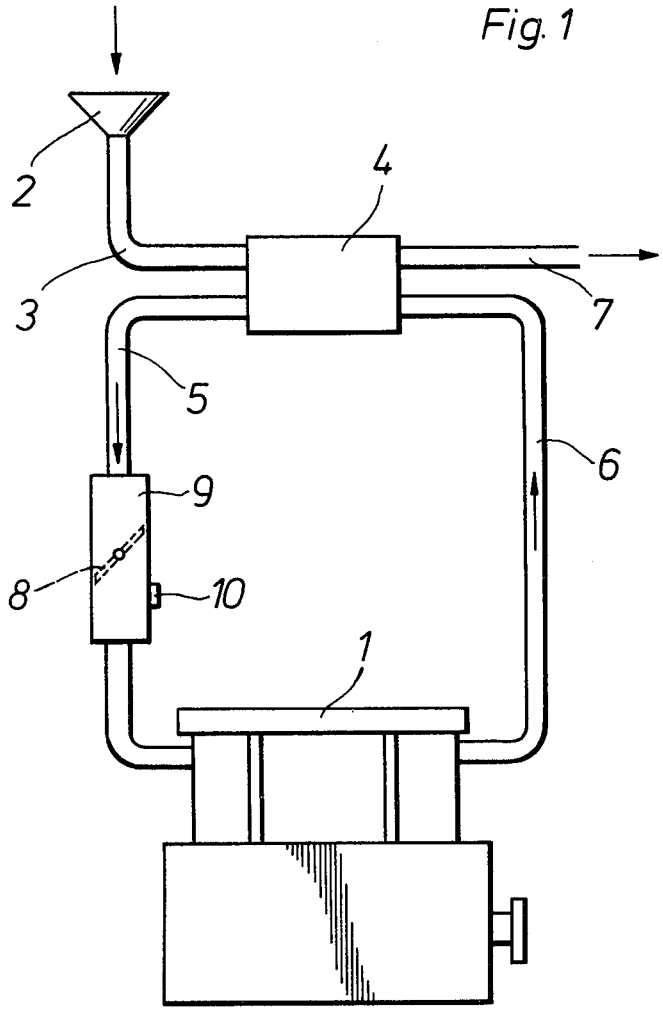

CONTROL APPARATUS FOR AN AIR THROTTLE VALVE IN THE INTAKE MANIFOLD OF AN INTERNAL COMBUSTION ENGINE

The present invention relates to a device for adjusting or actuating an air throttle valve disposed in the intake manifold of an internal combustion engine to which air is supplied under pressure, more particularly, to such a device which moves the air throttle valve in the opening direction in response to a predetermined pressure or vacuum in the intake manifold and holds the throttle valve in its open position.

In order to facilitate starting of a supercharged Diesel engine an air throttle valve has been mounted in the intake manifold. The air throttle valve remains closed at least until the engine starts and is then opened when the no-load or idle speed of the engine is exceeded for the first time after the engine has been started. The air throttle valve then remains open until the engine is shut off. Such an air throttle valve is particularly required for Diesel engines to which combustion air is supplied under pressure by means of a pressure booster or supercharger operated by pressure or compression waves produced by exhaust gases. If such an air throttle valve is not present, the changes between intake and exhaust which occur during the first few power strokes in the starting phase of the engine may cause exhaust gases to flow into the intake manifold which may bring about a stalling of the engine.

An adjustment device for an air throttle valve which is located in the air manifold leading from a supercharger has been proposed in DE-OS 2 631 257. The air throttle valve comprises a shut-off valve. The shut-off valve is actuated by a piston positioned in a pipe responsive to the pressure oil line leading to the Diesel engine. The adjustment piston is also acted upon by a constant force such that the shut-off valve is actuated in the opening direction by a control piston acting against the force of a spring under the action of pressure in the intake manifold. The shut-off valve can only be closed when there is no oil pressure. Only when the adjusting piston is in its rest or normal position in which the air throttle valve is closed can the shut-off valve be closed when there is no oil pressure.

In an even earlier proposal, which was not published, it was suggested to mount the air throttle valve upon a pivotable shaft which extends outwardly of the intake manifold. A spring is provided to pivot the shaft to close the air throttle valve. In order to pivot the shaft to open the air throttle valve, the shaft is connected to a gear lever which in turn is connected to a piston actuated by pressure or vacuum in the air intake line. The spring can be bi-metallic so that after the engine is shut down the throttle valve will be moved to its closed position only after the engine has cooled to a predetermined temperature.

Also, in this older proposal, it was suggested that the pivotal mounting of the air throttle valve be eccentric with respect to the throttle valve surface so that the non-symmetrical impact of pressure upon the throttle valve by the pressure prevailing in the intake line assists in the opening of the throttle valve.

It is therefore the principal object of the present invention to provide a novel and improved device for actuating an air throttle valve disposed in the intake manifold of an internal combustion engine which is supplied by air under pressure and for subsequently holding the throttle valve in its open position.

It is another object of the present invention to provide such an actuating device which will assure automatic, proper functioning and operation of the air throttle valve without the necessity for connecting the air throttle valve to the oil pressure pipe of the combustion engine.

It is a further object of the present invention to provide such an actuating device which is low in cost, simple in structure, can be easily installed and which is responsive to pressure or vacuum in the intake manifold of the internal combustion engine.

It is an additional object of the present invention to provide such an actuating device as described herein which is simpler in construction and function and requires less space than previously known actuating devices and at the same time is more economical in operation and has a higher safety and reliability factor.

It is still another object of the present invention to provide such an actuating device which incorporates a simple and effective structure to hold the air throttle valve in its open position.

According to one aspect of the present invention a device for actuating an air throttle valve disposed in the intake manifold of an internal combustion engine which is supplied with air under pressure may comprise a spring which acts to close the air throttle valve when the engine is in the cold starting phase. A by-pass valve is provided to supply combustion air to the engine when the air throttle valve is closed. Means are further provided which are operatively connected to the air throttle valve and act against the spring for opening the air throttle valve in response to a predetermined pressure or vacuum in the intake manifold and for holding the air throttle valve in an open position in response to energization of an ignition circuit of the engine and/or predetermined engine or exhaust gas temperatures.

Other objects and advantages of the present invention will be apparent upon reference to the accompanying description when taken in conjunction with the following drawings, which are exemplary, wherein;

FIG. 1 is a schematic representation of the actuating device of the present invention applied to a Diesel engine; and FIGS. 2–10 are schematic representations of sections of the intake air manifold showing different modifications of the throttle valve actuating device according to the present invention.

Proceeding next to the drawings wherein like reference symbols indicate the same parts throughout the various views a specific embodiment and modifications of the present invention will be described in detail.

In FIG. 1 a Diesel engine which is conventional, and thus is not described or illustrated in further detail, is indicated at 1. An air intake filter 2 is connected to an intake pipe 3 which leads to a supercharger or booster 4 from which air under pressure is discharged to an intake manifold 5. The supercharger 4 is connected to an exhaust pipe 6 leading from the Diesel engine 1 and is further provided with a pipe 7 through which air from the supercharger can be exhausted to the atmosphere.

A pipe or tubular section 9 is connected in the intake manifold 5 and a controlable or adjustable air throttle valve 8 is pivotally mounted within the pipe section 9.

The actuating mechanism actuates the air throttle valve 8 into a rest or closed position in which the air passage through the intake manifold 5 is blocked or shut off as shown in FIG. 1. The mechanism also actuates the air throttle valve 8 into an operating or open position in which the air passage through the intake manifold 5 is open. The actuating mechanism will be described in further detail below.

A by-pass valve 10 is disposed behind the air throttle valve 8 with respect to the direction of flow toward the engine 1 and, when the air throttle valve 8 is closed, functions to supply atmospheric air to the engine 1 if there is a predetermined underpressure or vacuum in that portion of the intake manifold 5 leading to the engine.

The supercharger or booster 4 may be of any suitable type as known in the art but is preferably of the type wherein intake air is boosted or charged by pressure or compressional waves of gases such as exhaust gases in which there is no strictly defined separation of the exhaust gases and intake air. The energy contained in the exhaust gases functions to compress the intake air. The necessary mechanical drive and structure for turbocharger 4 is known in the art and is thus not shown in FIG. 1.

Figure 2:
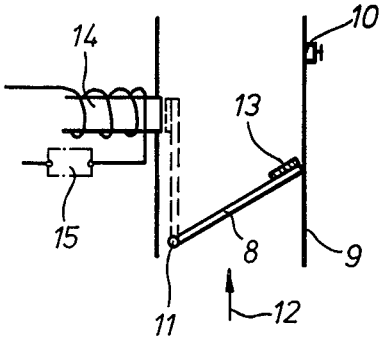

FIG. 2 shows the pipe section 9 of FIG. 1 in enlarged scale and in section. The throttle valve 8 is eccentrically mounted on a pivotable shaft 11 which defines a pivotable axis for the valve 8. The throttle valve 8 is illustrated in solid lines in its normal or closed position and in dashed lines in the open position. The shaft 11 is so positioned within the pipe section 9 that when the throttle valve 8 is in its full open position, the throttle valve is parallel to and adjacent the inner wall of the pipe section 9 as illustrated in FIG. 2.

A spring, which is not shown, retains the throttle valve 8 in its illustrated closed or inoperative position. On the other hand, the throttle valve 8 is moved in the opening direction against the spring force by the pressure of the intake air acting in a direction of the arrow 12 against the throttle valve. As long as the throttle valve 8 is in its closed position pressure is supplied to the motor through the by-pass valve 10.

A small plate or flat member 13 of a ferromagnetic material is mounted on the throttle valve 8 in a position which may be near the end of the valve, as shown in FIG. 2. The plate 13 is so positioned that in the open position of the throttle valve the ferromagnetic plate engages an end of an iron core of an electro-magnet 14 extending through the wall of the pipe section 9 as shown.

The electro-magnet 14 is connected to an ignition or an engine electrical circuit of the vehicle in which the engine is mounted. When the ignition circuit is energized, the throttle valve 8 will be held fast against the electro-magnet 14. When the ignition circuit is disconnected or deenergized upon shutting off of the motor, the electro-magnet 14 will also be deenergized and the throttle valve 8 will be returned to its inoperative or closed position under the action of the aforementioned spring.

The electro-magnet 14 is preferably connected to the vehicle ignition circuit through a thermal lag switch 15. The thermal switch 15 is so constructed that it closes the circuit when the engine is first started, such as, for example, when the exhaust gases of the engine have attained a predetermined temperature level. The thermal switch switches off the electro-magnet from the power source after the engine has been shut down and the engine has cooled down to a predetermined temperature level. Accordingly, should the warm engine become stalled so that it is shut down for a short period of time, the throttle valve 8 will not be closed unless the engine should be shut down for a sufficiently long period of time that the engine cools to a predetermined temperature level.

Insofar as the throttle valve 8 is pivotally mounted eccentrically with respect to its valve surface and along one of its outer edges as shown in FIG. 2, then the throttle valve in its pivoting plane must be limited by parallel lateral edges. The cross-section of the pipe section 9 in which the throttle valve 8 is mounted, must then conform to the shape of the throttle valve in order that the pipe section is completely blocked or shut off when the throttle valve is in its closed position. Thus, the cross-section of the pipe section 9 cannot be circular. The pipe section 9, at least in the region in which the throttle valve pivots, must be adapted to this particular shape of the throttle valve and such a shape, while not illustrated in the drawings, should present no problems in construction. It is also suitable according to the present invention that the pivot mount which in this construction is the valve shaft 11 is not located along an outer edge of the throttle valve as shown, but is moved to a position which is closer toward the center of the valve surface. However, the valve shaft should be located at such a distance from the center that the intake air pressure acting upon the throttle valve 8 will tend to move the throttle valve to its open position. Such a valve member pivot mount is illustrated in FIGS. 3–5 wherein the throttle valve 8, in its closed position, is illustrated in solid lines and in its open position by dashed lines.

Figure 3:
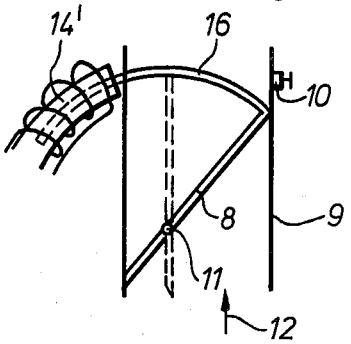
Figure 4:
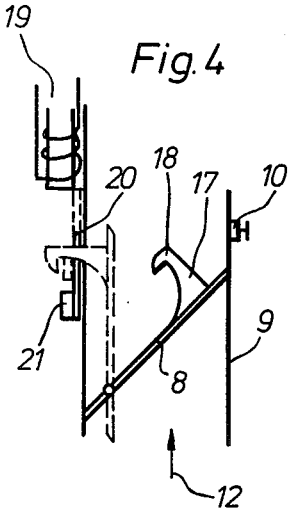
Figure 5:
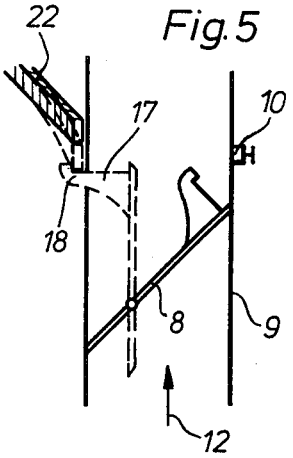
Figure 6:
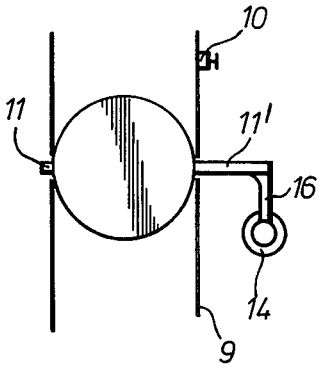

In the modifications of FIGS. 3–5, the throttle valve 8 is also retained in its closed position by a spring in the manner as disclosed above for FIG. 1. The throttle valves 8 are thus pivoted to their full open positions as shown in dashed lines only against spring force. The pivoting of the throttle valves of FIGS. 3–5 into their open positions is similarly achieved only through the intake air pressure acting in the directions of the arrows 12. The intake air pressure in the modification of FIG. 3 need only be sufficient to initiate the movement of the throttle valve 8 in the opening direction. The remaining portion of the opening stroke of the throttle valve can be provided by the action of an electro-magnet or the electro-magnet can function to at least assist in the opening of the throttle valve to its full open position.

The throttle valve 8 in FIG. 3 has a curved lever 16 mounted at a distance from the pivot shaft 11 and this lever is of a ferromagnetic material. When the throttle valve pivots into its open position within the pipe section 9 the arcuate lever will be received within the central opening of a curved coil electro-magnet 14'. The electro-magnet 14' may be directly connected to the ignition circuit of the vehicle or may be connected through a thermal lag switch as previously described. When current is thus passed through the magnetic coil 14' and the throttle valve 8 has begun to move in its opening direction under the force of the intake air, the lever 16 will be attracted into the central opening of the magnetic coil until the throttle valve has been pivoted to its full open position as shown in the dashed lines. The throttle valve 8 will remain in this open position against the spring force which is acting to return the throttle valve back to its closed position until the current through the magnetic coil is switched off and the magnetic field in the magnetic coil has dissipated. If the magnetic coil 14' is connected through a thermal lag switch corresponding to the construction of FIG. 2, then a switching off of the motor or a disconnecting of the ignition circuit will cause the thermal switch 15 to function in the same manner as described above with respect to FIG. 2.

Since the lever 16 is arc-shaped, only a simple small opening need be provided in the wall of the pipe section 9 to enable the arcuate lever 16 to move therethrough into the magnetic coil 14'. The lever 16 can also be mounted outside of the pipe section 9 as will be subsequently described in FIG. 6. In such a construction the shaft 11 is extended so as to have a portion 11' outside of the pipe section and the lever 16 is attached to this outside portion 11'.

In FIG. 4 there is a modification of the lever 16 in FIG. 3 and this modification consists of the throttle valve 8 having mounted thereon a lever or bracket arm 17 having on its end a hook or shoulder 18. In the open position of the throttle valve as shown in the dashed lines, the lever and shoulder 18 will extend outwardly through an opening in the wall of the pipe section 9. On the outer surface of the pipe section 9 there is mounted an electro-magnet 19 having a movable armature 20 on the end of which is a hook-shaped shoulder or detent 21. When the electro-magnet 19 is connected to a source of electrical energy, the armature 20 will be attracted by the magnetic coil of the electro-magnet. Since the throttle valve 8 is already being pivoted in the opening direction under the force exerted by the intake air acting in the direction of the arrow 12, the detent 21 will engage under the shoulder 18 to retain the throttle valve 8 in its open position. The throttle valve 8 is then pivoted back into its inoperative or open position under the force of a spring, not shown, when the current through the electro-magnet 19 is shut off and the armature 20 is released so as to disengage the shoulder 18 on lever 17 of the throttle valve.

Figure 7:
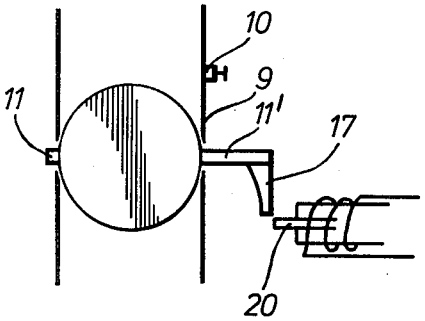
Figure 8:
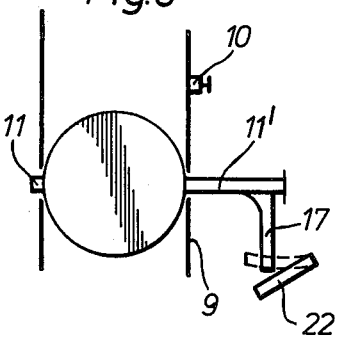

In the modification of FIG. 4 the electro-magnet 19 can also be connected through a thermal lag switch, such as 15 in FIG. 2, to an ignition circuit of the engine. Moreover, the lever 17 can also be mounted outside of the pipe section 9 on an extension 11' of the throttle valve shaft 11 in the manner as illustrated in FIG. 7.

If the electro-magnet 19 has already been energized and the armature attracted into the position as shown in the dashed lines in FIG. 4 before the throttle valve 8 has been pivoted into its full open position, the shoulder 18 on the lever 17 will still snap over the detent 21 since the leading or curved surface of the shoulder 18 will first engage the detent to briefly push the detent 21 out of the way to enable the shoulder 18 to snap over the detent 21. While not shown in the drawings, a resiliently mounted link can be provided to snap over the detent 21 of the armature 20 to hold the throttle valve in its open position. When the current to the electro-magnet 19 is shut off, the armature 20 will drop to release the throttle valve 8 which is now free to pivot back to its closed position under the action of a spring, not shown.

In the modification of FIG. 5, the function of holding of the throttle valve 8 in its open position is not performed by an electro-magnet as described above but by a bi-metallic member 22 mounted on the outside of the tubular section 9 and being connected so as to be responsive to the engine temperature or the temperature of the exhaust gases of the engine. Below the predetermined temperature levels of the engine or exhaust gases, the bi-metallic element 22 will be in its normal or inoperative position as illustrated in solid lines in FIG. 5. The throttle valve 8 is similarly provided with a lever or bracket arm 17 having on its end a shoulder or detent 18 which extends upwardly as viewed in FIG. 5 so as to be engageable by the bi-metallic element 22. When the throttle valve 8 pivots under the force of intake air in the direction of the arrow 12 out of its inoperative or rest position and into its open position as shown by the dashed lines in FIG. 5, the end of the lever 17 will pass through an opening in the wall of the pipe section 9 so that the shoulder 18 is in a position to be engageable by the bi-metallic member 22.

As the engine or exhaust gas temperature increases to a predetermined temperature level, the bi-metallic member 22 will deflect downwardly into the position indicated by the dashed lines so as to engage the shoulder 18 and to hold the throttle valve 8 in the open position. It is apparent that the bi-metallic member 22 can also be mounted inside of the pipe section 9. It would then not be necessary that the lever 17 with its shoulder 18 pass through an opening in the wall of the pipe section 9. On the other hand, the bi-metallic element 22 can also lock or hold the throttle valve 8 in its open position by engaging behind the lever 17 mounted on an extension 11' of the throttle valve shaft 11. Should be bi-metallic member move to its blocking position before the throttle valve 8 with its lever 17 is pivoted to its full open position, it is also possible to achieve a coupling between the bi-metallic element and the lever 17 by utilizing a resilient or resiliently mounted link or latch.

Figure 9:
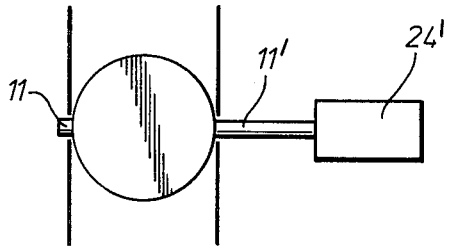
Figure 10:
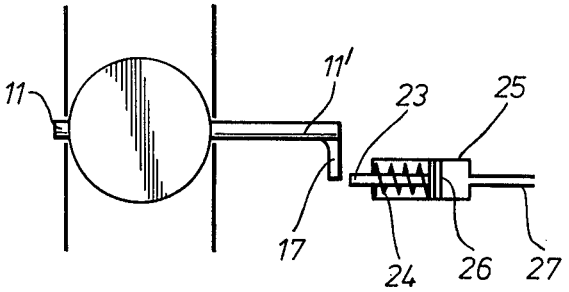

In the modifications of FIGS. 6–10, the throttle valve 8 is mounted upon a shaft 11 which is journaled for pivotal movement in the wall of the pipe section 9. In the modifications of FIGS. 6–8 and 10, the shaft 11 is provided with an elongation or extension 11' which extends outwardly of the pipe section 9 and upon which is mounted a lever 17. With respect to the lever 17 performing the function of retaining the throttle valve 8 in its open position according to FIG. 6, there may be provided an electro-magnet 14 similar to that of FIG. 2, an electro-magnet 19 similar to that of FIG. 4 or a bi-metallic element corresponding to that of FIG. 5. The relationships are so selected that a shaft 11 is rotated into such a position when the throttle valve is open that the lever is positioned closely in front of or beside an electro-magnet or bi-metallic member, respectively, so that the electro-magnet when it is energized holds the lever 16, in an open position only through magnetic force (in FIG. 6) or the armature 20 is coupled with the lever 17 (in FIG. 7) or the bi-metallic body 22 is moved into the path of the lever 17 at the selected motor temperature (in FIG. 8.) In FIG. 10, instead of magnetic armatures or bi-metallic elements in the pivoting range of the levers, there is provided a piston rod 23 extending outwardly of a cylinder 25 and attached to a piston 26 acted upon by a spring 24 which acts in a direction opposite to a force exerted against the piston 26 by oil pressure of the engine. The cylinder 25 is connected by a line 27 to the oil pressure circuit of the engine.

In FIG. 9, an electrical servo-motor 25 is connected to the shaft extension 11' of air throttle valve shaft 11 so that upon energization of the servo-motor a torque is imposed upon the shaft which will retain the air throttle valve in its open position. The servo-motor 24' can also be connected into the ignition circuit of the vehicle in the manner of that of the electro-magnet 14 as described above. The coupling between the shaft and extension 11' and the servo-motor 24' is so selected that the air throttle valve can be pivoted by intake air pressure into the open position without being hindered by the servo-motor. The air throttle valve will be retained in the open position upon switching on of the servo-motor. The servo-motor can also be connected to the circuit through a thermal lag switch 15 such as described above with respect to the electro-magnet 14.

As previously described in the non-published disclosure discussed above, the throttle valve can also be held and actuated on its pivotable mount in the air intake manifold by means of a shaft extending out of the air intake so that the shaft is rotated by a mechanical spring to close the throttle valve and the shaft is rotated in the opposite direction into the open position of the throttle valve by means of a lever gear system connected to a piston acted upon at least by the pressure of air in the air intake manifold or by a vacuum.

According to the present invention, the piston can be so constructed that in its end position in which the throttle valve is open, it is engaged or contacted by an electro-magnet connected to the ignition circuit of the vehicle which maintains the throttle valve in this open position so long as the ignition circuit is closed or energized. The piston can be constructed of a plastic or synthetic resin material and provided with an iron plate so it can be held fast to a surface of the electro-magnet such that the piston is held magnetically in its end position by the energized electro-magnet.

Thus it can be seen that the present invention has disclosed a structure for actuating an air throttle valve in the air intake line of an internal combustion engine wherein the apparatus occupies a minimum of space, is simple in construction, reliable in operation and provides an effective structure for holding the air throttle valve in its open position and, subsequently, releasing the air throttle valve to enable the valve to be returned to its normal closed position by a spring or the like.

It will be understood that this invention is susceptible to modification in order to adapt it to different usages and conditions and, accordingly, it is desired to comprehend such modifications within this invention as may fall within the scope of the appended claims.

What is claimed is:

1. A device for adjusting an air throttle valve disposed in an intake manifold of an internal combustion engine charged by a pressure wave supercharger which, during the cold start-phase of the engine, is maintained in a closed position by a spring force whereby the engine receives combustion air through a by-pass valve, the air throttle valve being regulated into its open position against the spring force at the end of the start phase and remains in its open position during running of the engine and returns to its closed position under action of the spring force after the engine is shut off, said air throttle valve being mounted eccentrically with respect to its valve surface so as to be actuated after the cold start phase directly by the accumulated pressure of charged air in front of the closed air throttle valve in the intake manifold into its open position or at least in the opening direction, electrically operable means in an ignition circuit of the engine for maintaining the air throttle valve in its open position by energization of the ignition circuit, the air throttle valve returning to its closed position by the spring force upon deenergization of the ignition circuit.

2. A device as claimed in claim 1 wherein the air throttle valve begins movement in the opening direction solely by the pressure of the charged air in the intake manifold, said electrically operable means is actuated by the energization of the ignition circuit to move the air throttle valve from a partially open position to a full open position and to maintain the air throttle valve in its full open position.

3. A device as claimed in claim 1 or claim 2 wherein said electrically operable means comprises one of an electromagnet or an electrical servo motor.

4. A device as claimed in claim 3 wherein said electrically operable means acts upon a detent by energization of the ignition circuit to move the detent from an inoperative position to an operative position to maintain the air throttle valve in its open position.

5. In a device as claimed in claim 4 and further comprising an electro-magnet connected to an ignition circuit of a vehicle in which the engine is mounted and operatively connected to said detent.

6. In a device as claimed in claim 4 wherein said detent is moved to its operative position before said throttle valve attains a full open position, a spring-loaded lever engageable with said detent when said throttle valve is in the full open position to hold said throttle valve in said position, said lever being disengaged from said detent when the detent is moved to its operative position.

7. A device as claimed in claim 3 wherein there is a lever on said air throttle valve or on a pivotable shaft upon which said air throttle valve is mounted, in the open position of the air throttle valve said lever is locked behind a detent actuated by the electrically operable means, the detent is movable by the electrically operable means from a position disengaged from the air throttle valve to its retained open position.

8. In a device as claimed in claim 2 wherein said actuating means comprises a ferromagnetic element acted upon by said electro-magnet in opening said throttle valve or holding said throttle valve open.

9. In a device as claimed in claim 2 wherein said electro-magnet comprises a coil having an opening therethrough, and a lever of ferromagnetic material connected to said air throttle valve at a distance from the mount of said valve and movable within said coil opening.

10. In a device as claimed in claim 2 wherein said throttle valve is mounted on a pivotable shaft, said shaft having a portion thereof extending outwardly of said intake manifold and a lever attached to said outward portion, said lever being acted upon by said electro-magnet to assist in the opening of the throttle valve or holding the throttle valve in an open position.

* * * * *